US005938399A

United States Patent [19]

Knutson

[11] Patent Number: 5,938,399

[45] Date of Patent: Aug. 17, 1999

[54] SKID STEER LOADER ROTATABLE ATTACHMENT

[76] Inventor: Ken Knutson, RR 2 Box 67, Toronto, S. Dak. 57268-9731

[21] Appl. No.: 08/883,566

[22] Filed: Jun. 26, 1997

[51] Int. Cl.[6] ..... E02F 3/78

[52] U.S. Cl. ..... 414/722; 37/468

[58] Field of Search ..... 414/723, 722, 414/725, 620, 621, 622, 664, 668; 37/468, 411

[56] References Cited

U.S. PATENT DOCUMENTS

| | | | |
|---|---|---|---|
| 2,807,382 | 9/1957 | Schenkelberger | 414/622 |
| 2,815,878 | 12/1957 | Vance | 414/620 |
| 3,182,831 | 5/1965 | Bergmann | 414/722 X |
| 3,227,299 | 1/1966 | Draxler | 414/621 |
| 3,941,262 | 3/1976 | Moser et al. | 37/468 X |
| 4,013,182 | 3/1977 | Pratt et al. . | |
| 4,474,495 | 10/1984 | Ledwell, Jr. | 414/621 X |
| 4,545,720 | 10/1985 | Cochran et al. . | |
| 4,850,789 | 7/1989 | Zimmerman . | |
| 4,929,143 | 5/1990 | Dohnalik . | |
| 5,078,569 | 1/1992 | Cook . | |
| 5,098,252 | 3/1992 | Sheesley et al. . | |
| 5,114,299 | 5/1992 | Roche et al. . | |
| 5,195,865 | 3/1993 | Koehl . | |
| 5,382,110 | 1/1995 | Perotto et al. . | |
| 5,403,144 | 4/1995 | Staben, Jr. . | |
| 5,562,398 | 10/1996 | Knutson . | |

*Primary Examiner*—Donald W. Underwood
*Attorney, Agent, or Firm*—Kaardal & Associates, PC

[57] ABSTRACT

A rotatable attachment is provided for rotatably mounting a variety of work attachments to a skid steer loader. The inventive device includes a base assembly removably mountable to the lift arms of a skid steer loader and a rotational assembly rotatably coupled to the base assembly, wherein the rotational assembly is rotatable relative to the base assembly by means of a rotation system and is adapted for removable mounting of a work attachment thereto. As such, the rotational assembly and the work attachment are conjointly rotatable through 360 degrees in a plane which is transverse to a longitudinal axis of the lift arms of the skid steer loader.

12 Claims, 7 Drawing Sheets

SKID STEER LOADER ROTATABLE ATTACHMENT

BACKGROUND OF THE INVENTION

1. Field of the Invention

The present invention relates to skid steer loader attachments and more particularly pertains to a new Skid Steer Loader Rotatable Attachment for rotatably mounting a variety of work attachments to a skid steer loader.

2. Description of the Prior Art

The use of skid steer loader attachments is known in the prior art. More specifically, skid steer loader attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art skid steer loader attachments include U.S. Pat. No. 4,013,182; U.S. Pat. No. 4,545,720; U.S. Pat. No. 4,850,789; U.S. Pat. No. 4,929,143; U.S. Pat. No. 5,078,569; U.S. Pat. No. 5,098,252; U.S. Pat. No. 5,114,299; U.S. Pat. No. 5,195,865; U.S. Pat. No. 5,382,110; U.S. Pat. No. 5,403,144; and U.S. Pat. No. 5,562,398.

While these devices fulfill their respective, particular objectives and requirements, the aforementioned patents do not disclose a new Skid Steer Loader Rotatable Attachment. The inventive device includes a base assembly removably mountable to the lift arms of a skid steer loader and a rotational assembly rotatably coupled to the base assembly, wherein the rotational assembly is rotatable relative to the base assembly by means of a rotation system and is adapted for removable mounting of a work attachment thereto. As such, the rotational assembly and the work attachment are conjointly rotatable through 360 degrees in a plane which is transverse to a longitudinal axis of the lift arms of the skid steer loader.

In these respects, the Skid Steer Loader Rotatable Attachment according to the present invention substantially departs from the conventional concepts and designs of the prior art, and in so doing provides an apparatus primarily developed for the purpose of rotatably mounting a variety of work attachments to a skid steer loader.

SUMMARY OF THE INVENTION

In view of the foregoing disadvantages inherent in the known types of skid steer loader attachments now present in the prior art, the present invention provides a new Skid Steer Loader Rotatable Attachment construction wherein the same can be utilized for rotatably mounting a variety of work attachments to a skid steer loader.

The general purpose of the present invention, which will be described subsequently in greater detail, is to provide a new Skid Steer Loader Rotatable Attachment apparatus and method which has many of the advantages of the skid steer loader attachments mentioned heretofore and many novel features that result in a new Skid Steer Loader Rotatable Attachment which is not anticipated, rendered obvious, suggested, or even implied by any of the prior art skid steer loader attachments, either alone or in any combination thereof.

To attain this, the present invention generally comprises a base assembly removably mountable to the lift arms of a skid steer loader and a rotational assembly rotatably coupled to the base assembly, wherein the rotational assembly is rotatable relative to the base assembly by means of a rotation system and is adapted for removable mounting of a work attachment thereto. As such, the rotational assembly and the work attachment are conjointly rotatable through 360 degrees in a plane which is transverse to a longitudinal axis of the lift arms of the skid steer loader.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Skid Steer Loader Rotatable Attachment apparatus and method which has many of the advantages of the skid steer loader attachments mentioned heretofore and many novel features that result in a new Skid Steer Loader Rotatable Attachment which is not anticipated, rendered obvious, suggested, or even implied by any of the prior art skid steer loader attachments, either alone or in any combination thereof.

It is another object of the present invention to provide a new Skid Steer Loader Rotatable Attachment which may be easily and efficiently manufactured and marketed.

It is a further object of the present invention to provide a new Skid Steer Loader Rotatable Attachment which is of a durable and reliable construction.

An even further object of the present invention is to provide a new Skid Steer Loader Rotatable Attachment which is susceptible of a low cost of manufacture with regard to both materials and labor, and which accordingly is then susceptible of low prices of sale to the consuming public, thereby making such Skid Steer Loader Rotatable Attachment economically available to the buying public.

Still yet another object of the present invention is to provide a new Skid Steer Loader Rotatable Attachment which provides in the apparatuses and methods of the prior art some of the advantages thereof, while simultaneously overcoming some of the disadvantages normally associated therewith.

Still another object of the present invention is to provide a new Skid Steer Loader Rotatable Attachment for rotatably mounting a variety of work attachments to a skid steer loader.

Yet another object of the present invention is to provide a new Skid Steer Loader Rotatable Attachment which includes a base assembly removably mountable to the lift arms of a skid steer loader and a rotational assembly rotatably coupled to the base assembly, wherein the rotational assembly is rotatable relative to the base assembly by means of a rotation system and is adapted for removable mounting of a work attachment thereto. As such, the rotational assembly and the work attachment are conjointly rotatable through 360 degrees in a plane which is transverse to a longitudinal axis of the lift arms of the skid steer loader.

Still yet another object of the present invention is to provide a new Skid Steer Loader Rotatable Attachment that expands the functional use of work attachments by enabling the work attachments to be rotated clockwise and counter-clockwise through 360 degrees.

Even still another object of the present invention is to provide a new Skid Steer Loader Rotatable Attachment that allows a variety of work attachments, including buckets, blades, pallet forks, grapples, and the like, to be rotatably mounted to a skid steer loader.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
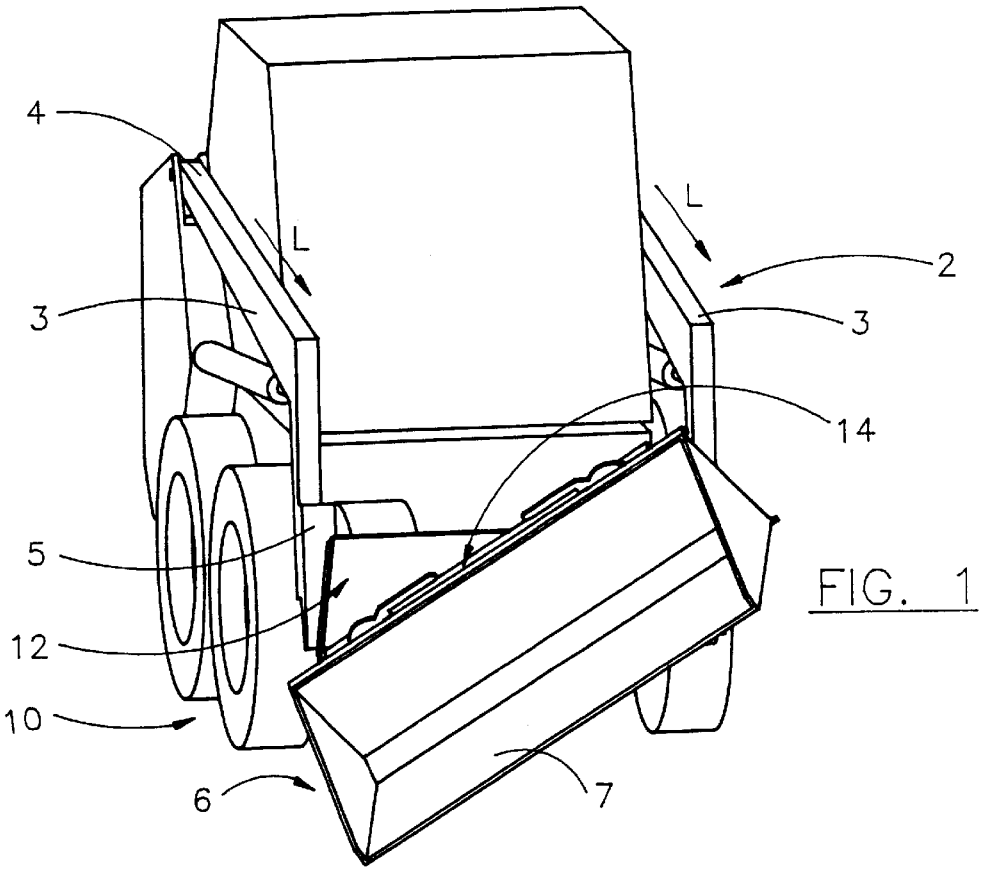
FIG. 1 is a front perspective view of a conventional skid steer loader with the rotatable attachment mounted between the lift arms and the work attachment.

With reference now to the drawings, and in particular to FIGS. 1 through 10 thereof, a new Skid Steer Loader Rotatable Attachment embodying the principles and concepts of the present invention and generally designated by the reference numeral 10 will be described.

As best illustrated in FIGS. 1 through 10, the Skid Steer Loader Rotatable Attachment 10 comprises a base assembly 12 removably mountable to the lift arms 3 of a skid steer loader 2 and a rotational assembly 14 rotatably coupled to the base assembly 12, wherein the rotational assembly 14 is rotatable relative to the base assembly 12 by means of a rotation system 16 and is adapted for removable mounting of a work attachment 6 thereto. As such, the rotational assembly 14 and the work attachment 6 are conjointly rotatable through 360 degrees in a plane which is transverse to a longitudinal axis L of the lift arms 3 of the skid steer loader 2.

Figure 2:
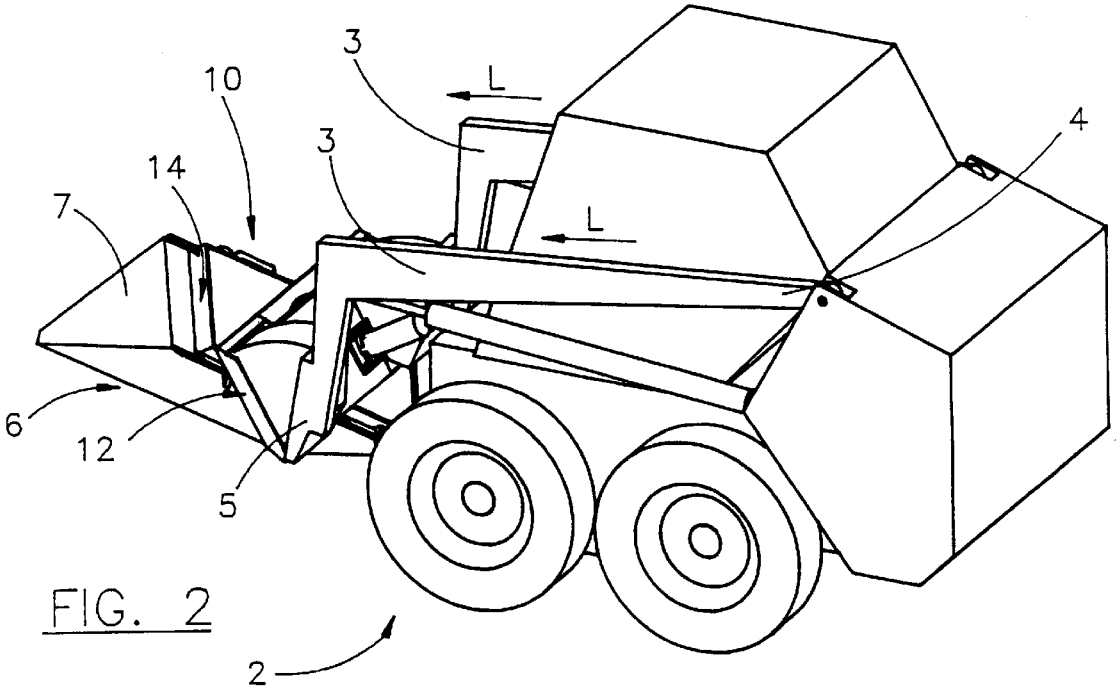
FIG. 2 is a side perspective view of a conventional skid steer loader with the rotatable attachment mounted between the lift arms and the work attachment.
Figure 3:
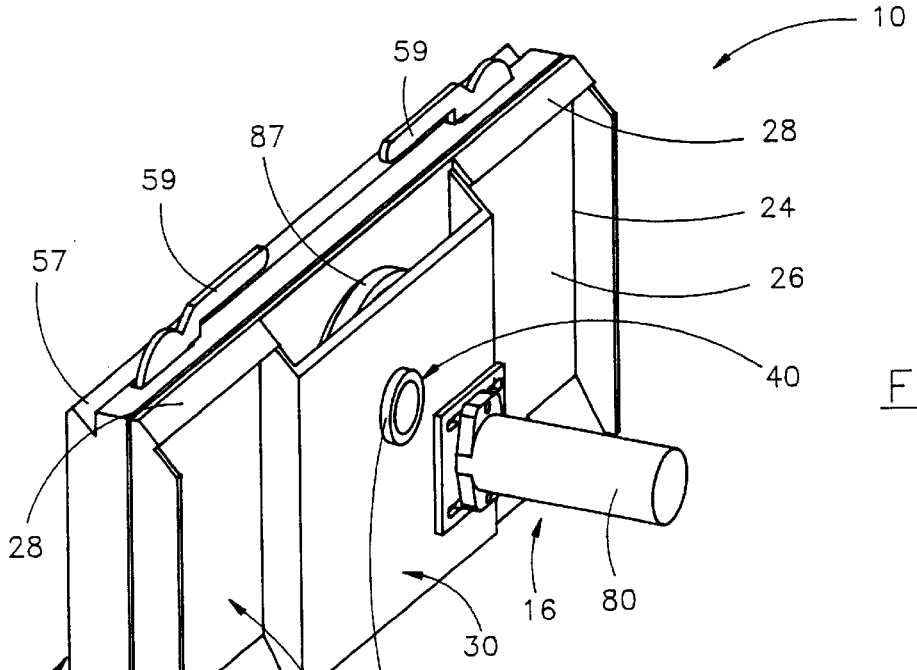
FIG. 3 is a rear perspective view of the present invention.
Figure 4:
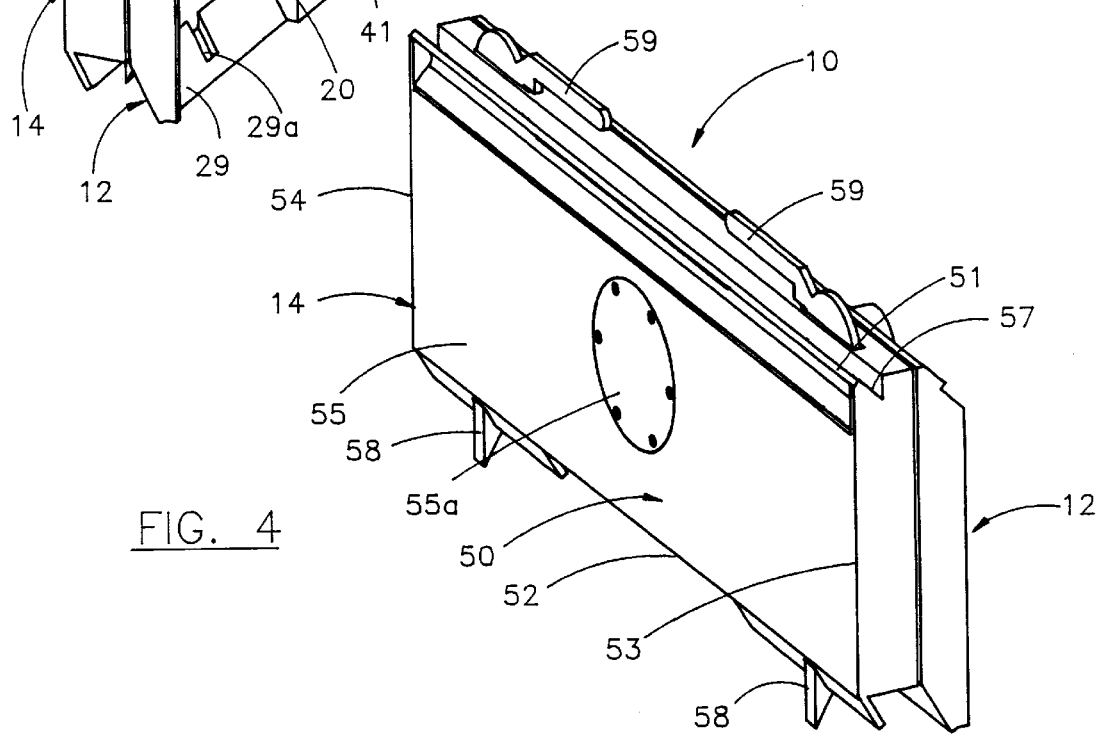
FIG. 4 is a front perspective view of the present invention.
Figure 5:
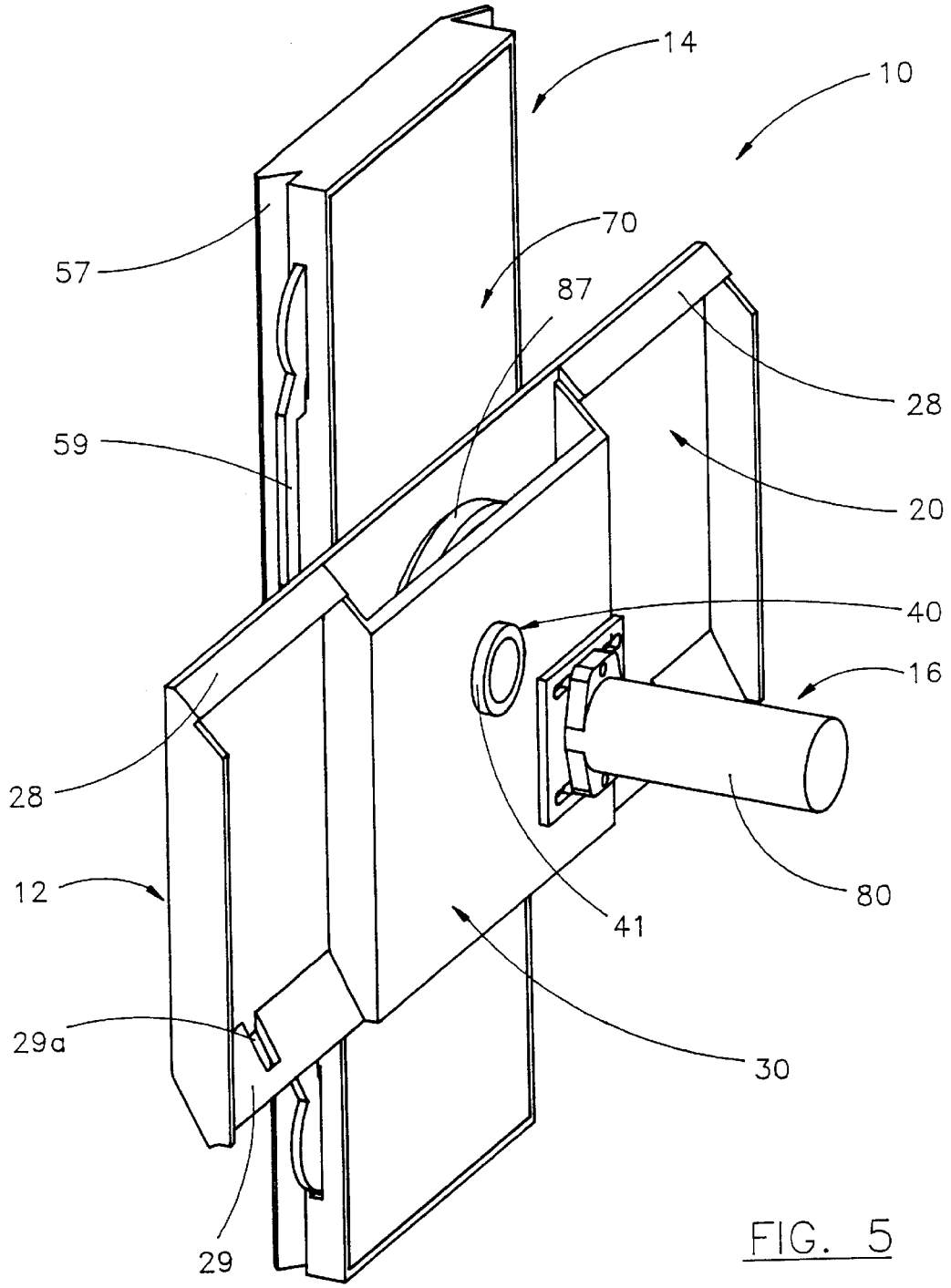
FIG. 5 is an illustration of the rotational assembly rotating relative to the base assembly according to the present invention.

As best illustrated in FIGS. 1 and 2, the Skid Steer Loader Rotatable Attachment 10 is intended for use with a skid steer loader 2 including a pair of spaced lift arms 3 each having a rearward end 4 pivotally coupled to opposite sides of the skid steer loader 2 and a forward end 5 to which a work attachment 6 may be removably mounted. In the present invention, however, the Skid Steer Loader Rotatable Attachment 10 is removably mounted on the lift arms 3 of the skid steer loader 2 and the work attachment 6 is removably mounted on the Skid Steer Loader Rotatable Attachment 10. Common work attachments 6 include a bucket 7 (as shown in FIGS. 1 and 2), a blade, a pallet fork, a grapple, and the like. Each of the lift arms 3 have a longitudinal axis L.

As best illustrated in FIGS. 3 through 8, the base assembly 12 includes a base plate 20 and a shroud 30 offset from and affixed to the base plate 20 in parallel spaced relation. The base plate 20 is generally rectangular in shape and has a top edge 21, a bottom edge 22, a first end 23, and a second end 24. In addition, the base plate 20 has a front face 25 and a rear face 26. The base plate 20 has a hole 27 therethrough intermediate the first end and 23 the second end 24 thereof. The shroud 30 is secured to the rear face 26 of the base plate 20 adjacent the hole 27 therein. The base assembly 12 also includes a shaft 40 having a first end 41 secured to the shroud 30 and a second end 42 perpendicularly extending through the hole 27 in the base plate 20.

The base assembly 12 is configured for mounting to the lift arms 3 of the skid steer loader 2. As such, the mounting configuration of the base assembly 12 is dictated by the configuration of the lift arms 3 of the skid steer loader 2. The configuration of the lift arms 3, however, may vary according to the manufacturer and the model of the skid steer loader 2.

Accordingly, in an illustrative embodiment, the base assembly 12 includes an upper lip 28 provided along the top edge 21 of the base plate 20 adjacent the first end 23 and the second end 24 thereof. The upper lip 28 protrudes angularly downward from the rear face 26 of the base plate 20. In addition, a lower lip 29 is provided along the bottom edge 22 of the base plate 20 adjacent the first end 23 and the second end 24 thereof. The lower lip 29 protrudes angularly downward from the rear face 26 of the base plate 20 and has a lock port **29*a* formed therein. As such, the upper lip 28 is adapted to fit over an upper edge of the forward end 5 of each of the lift arms 3 and the lock port 29*a* is adapted to receive a lock pin (not shown) provided at the forward end 5 of each of the lift arms 3**.

As best illustrated in FIGS. 3 through 8, the rotational assembly 14 includes a front rotational plate 50. The front rotational plate 50 is generally rectangular in shape and has a top edge 51, a bottom edge 52, a first end 53, and a second end 54. In addition, the front rotational plate 50 has a front face 55 and a rear face 56. The rotational assembly 14 also includes a sleeve 60 having a first end 61 secured to the front rotational plate 50 and a second end 62 perpendicularly projecting from the rear face 56 of the front rotational plate 50. The second end 62 of the sleeve 60 fits through the hole 27 in the base plate 20. As such, the shaft 40 of the base assembly 12 is rotatably fitted within the sleeve 60 of the rotational assembly 14 whereby the rotational assembly 14 rotates relative to the base assembly 12 about the shaft 40 of the base assembly 12.

Figure 6:
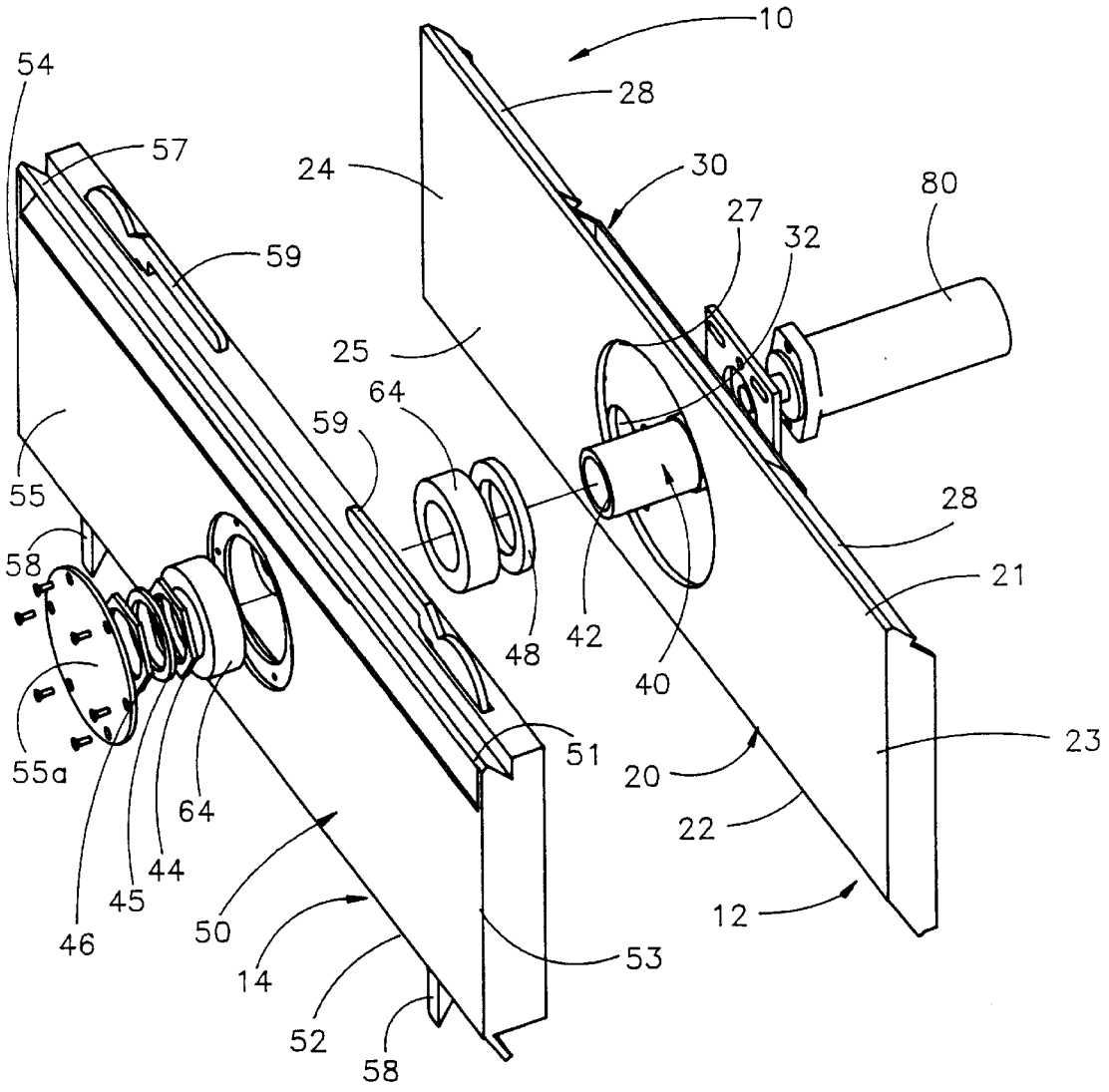
FIG. 6 is a partially exploded front perspective view of the present invention.
Figure 7:
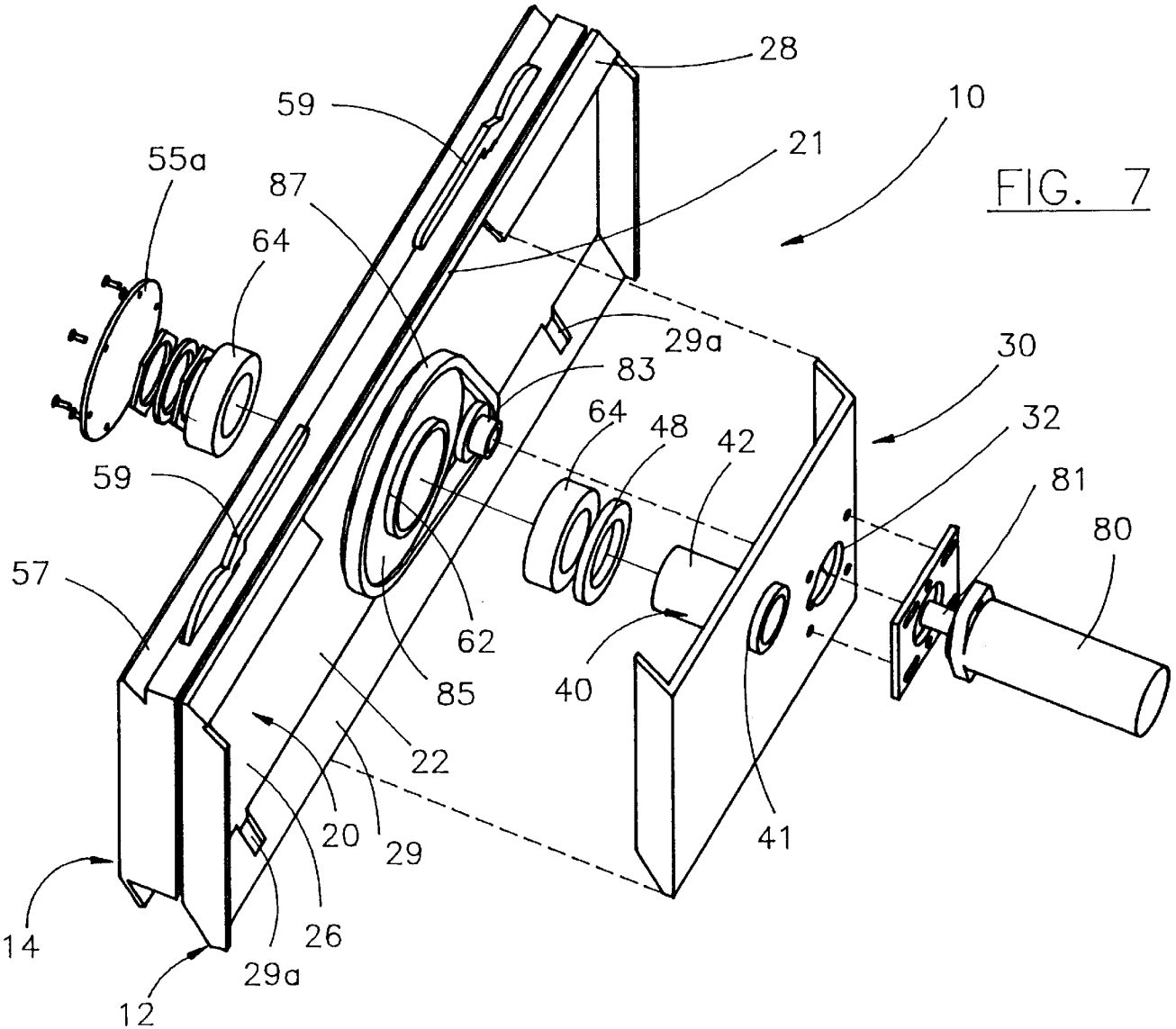
FIG. 7 is a partially exploded rear perspective view of the present invention.
Figure 8:
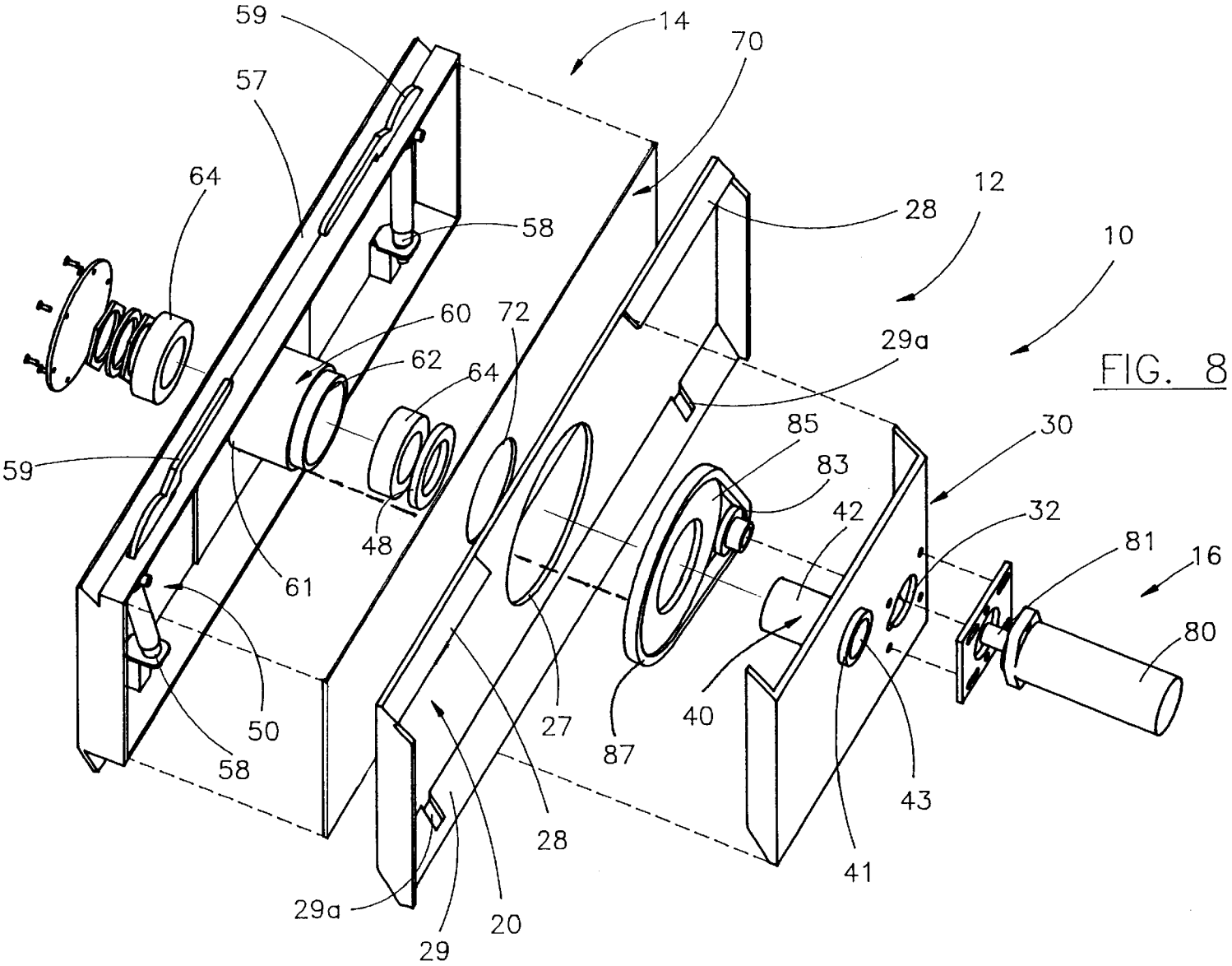
FIG. 8 is a fully exploded rear perspective view of the present invention.

In a preferred embodiment, a pair of bearings 64 are fitted within the sleeve 60 and the shaft 40 of the base assembly 12 is fitted within the bearings 64 (FIGS. 6 through 8). As such, the rotational assembly 14 freely rotates about the shaft 40 of the base assembly 12. In the preferred embodiment, an inner nut 44, a lock ring 45, and an outer nut 46 are fastened to the second end 42 of the shaft 40 from the front face 55 of the front rotational plate 50 so as to retain the shaft 40 within the sleeve 60. An access plate 55*a* is provided in the front face 55 of the front rotational plate 50 and covers the second end 42 of the shaft 40, the outer nut 46, and one of the bearings. A seal 48 is interposed between the other bearing and the shroud 30 of the base assembly 12.

The rotational assembly 14 is configured for removable mounting of the work attachment 6 thereto. As such, the mounting configuration of the rotational assembly 14 is dictated by the configuration of the work attachment 6. The configuration of the work attachment 6, however, may vary according to the manufacturer.

Accordingly, in an illustrative embodiment, the rotational assembly 14 includes a retaining ledge 57 provided along the top edge 51 of the front rotational plate 50. Preferably, the retaining ledge 57 is oriented angularly downward. In addition, the rotational assembly 14 includes a pair of generally vertically retractable locking pins 58 mounted adjacent the first end 53 and the second end 54 of the front rotational plate 50. Each of the retractable locking pins 58 retractably protrude from the bottom edge 52 of the front rotational plate 50. As such, the retaining ledge 57 of the rotational assembly 14 is positionable under an upper retaining member provided on the work attachment 6 and each of the retractable locking pins 58 are insertable through holes provided in a lower bracket of the work attachment 6. Each of the retractable locking pins 58 include a release lever 59 for use in retracting the retractable locking pins 58 from the holes in the lower bracket.

In a preferred embodiment, the rotational assembly 14 includes a rear rotational plate 70 secured to the edges of the rotational assembly 14. As such, the rear rotational plate 70 conceals the retractable locking pins 58. The rear rotational plate 70 has a hole 72 therein through which the second end 62 of the sleeve 60 extends.

The rotation system 16 is operable to rotate the rotational assembly 14 relative to the base assembly 12 through 360 degrees clockwise and counterclockwise in a plane transverse to the longitudinal axis L of the lift arms 3 of the skid steer loader 2. In a first embodiment, illustrated in FIGS. 3 through 8, the rotation system 16 comprises a hydraulic actuator 80 including a drive shaft 81, a driver sprocket 83 mounted to and driven by the drive shaft 81, and a driven sprocket 85 driven by the driver sprocket 83. In a preferred embodiment, rotational motion of the driver sprocket 83 is transferred to the driven sprocket 85 by a chain 87. The driver sprocket 83, the driven sprocket 85, and the chain 87 are positioned between the base plate 20 and the shroud 30 of the base assembly 12.

The hydraulic actuator 80 is mounted to the base assembly 12 and, more specifically, is mounted to the shroud 30 of the base assembly 12. The drive shaft 81 of the hydraulic actuator 80 extends through a hole 32 provided in the shroud 30. The driven sprocket 85 is fixedly mounted on the sleeve 60 of the rotational assembly 14 adjacent the second end 62 thereof. As such, the driven sprocket 85 and the sleeve 60 of the rotational assembly 14, and thereby the rotational assembly 14 itself, conjointly rotate about the shaft 40 of the base assembly 12. Illustratively, the hydraulic actuator 80 is of the kind commercially available such as a Model 2000 Series hydraulic actuator manufactured by Charlynn Hydraulics.

Figure 9:
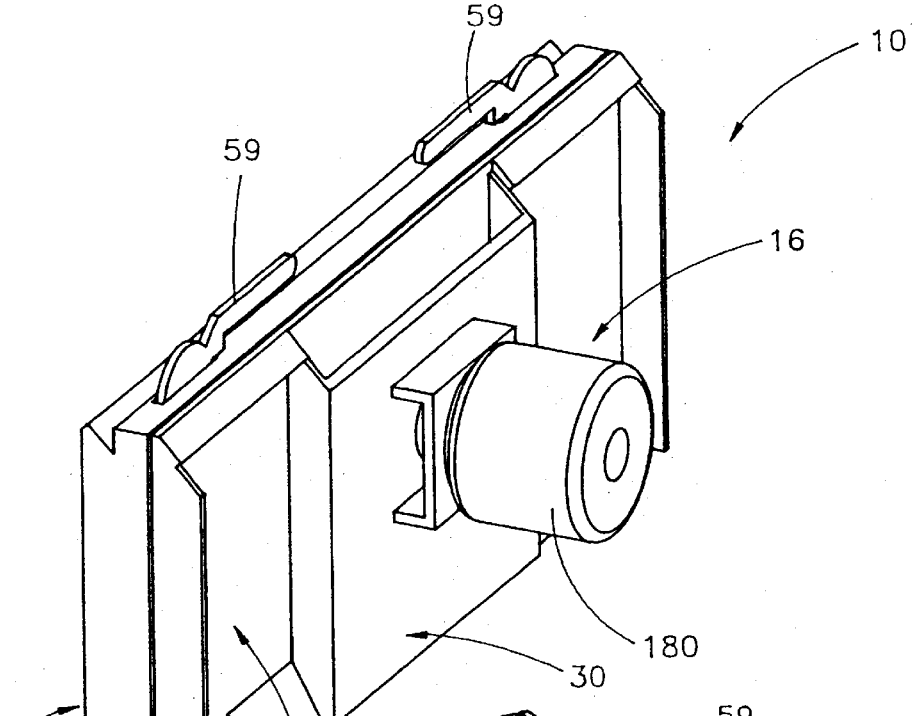
FIG. 9 is rear perspective view of a second embodiment of the rotation system of the present invention.
Figure 10:
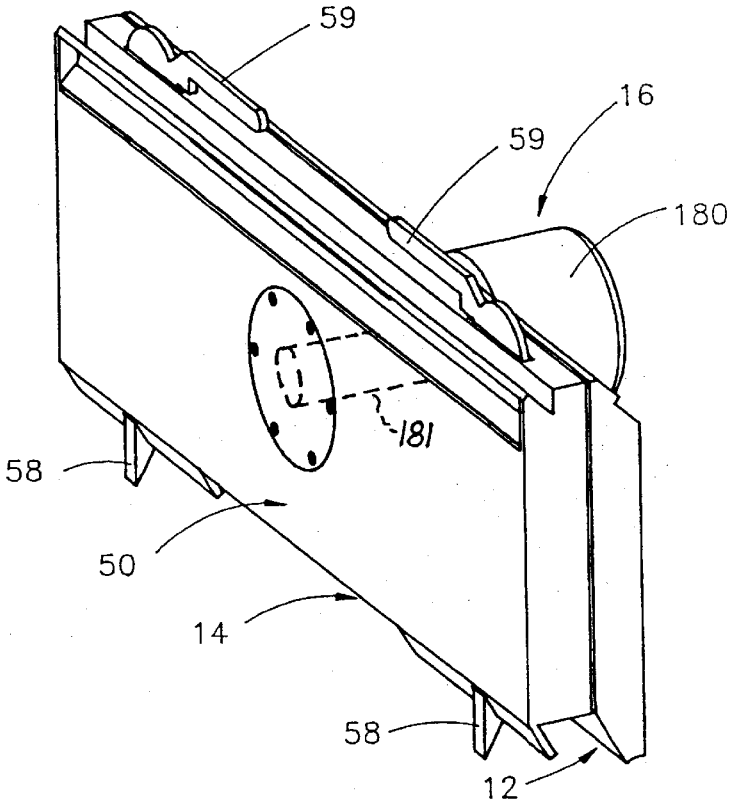
FIG. 10 is front perspective view of the second embodiment of the rotation system of the present invention.

In a second embodiment, illustrated in FIGS. 9 and 10, the rotation system 16 comprises a direct hydraulic actuator 180 including a direct drive shaft 181 having a free end. The direct hydraulic actuator 180 is mounted to the base assembly 12 such that the direct drive shaft 181 extends through a bore 43 provided through the shaft 40 of the base assembly 12. As such, the free end of the direct drive shaft 181 also extends through the sleeve 60 of the rotational assembly 14 wherein the free end is secured to the rotational assembly 14. Preferably, the free end of the direct drive shaft 181 is secured to the front rotational plate 50 of the rotational assembly 14 by a flange (not shown). Illustratively, the direct hydraulic actuator 180 is a low speed, high torque vane-type actuator of the kind commercially available such as that manufactured by Dynex.

In use, the Skid Steer Loader Rotatable Attachment 10 is removably mounted on the lift arms 3 of the skid steer loader 2 whereby the upper lip 28 of the base assembly 12 fits over an upper edge of the forward end 5 of each of the lift arms 3. A lock pin (not shown) provided at the forward end 5 of each of the lift arms fits 3 into the lock port 29*a* provided in the lower lip 29 of the base assembly 12 and locks the Skid Steer Loader Rotatable Attachment 10 to the lift arms 3.

Thereafter, the work attachment 6 is removably mounted on the Skid Steer Loader Rotatable Attachment 10 whereby the retaining ledge 57 of the rotational assembly 14 is positioned under an upper retaining member provided on the work attachment 6 and each of the retractable locking pins 58 are inserted through holes provided in a lower bracket of the work attachment 6. As such, the rotational assembly 14 and the work attachment 6 are conjointly rotatable through 360 degrees in a plane which is transverse to the longitudinal axis L of the lift arms 3 of the skid steer loader 2 thereby increasing the versatility of the work attachment 6.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device for converting a non-rotatable skid steer loader work attachment to a rotatable skid steer loader work attachment, said skid steer loader having a pair of lift arms with each lift arm having a longitudinal axis said device comprising:

a base assembly having lift arm mounting means thereon for removably mounting said base assembly to a pair of lift arms of a skid steer loader, said lift arm mounting means being adapted such that said base assembly is removable from said lift arms to permit direct mounting of a work attachment to said lift arms when desired;

a rotational assembly rotatable coupled to said base assembly by a pivot assembly; and a rotation means for rotating said rotational assembly relative to said base assembly through 360 degrees in a plane substantially transverse to said longitudinal axis of each of said pair of lift arms of said skid steer loader, said rotational assembly including a work attachment mounting means adapted for mounting of a work attachment thereto whereby said rotational assembly and said work attachment are conjointly rotatable relative to said base assembly, said work attachment mounting means being adapted such that said work attachment is removable from said rotational assembly to permit mounting of a different work attachment to said rotational assembly when desired, whereby said base assembly and said rotational assembly form a unit removably interposable between said skid steer loader and said work attachment to permit selective rotational mounting of a variety of work attachments to said skid steer loader;

wherein said base assembly comprises:

a base plate having a top edge and a bottom edge and having a front face and a rear face said base plate having a hole therethrough, a shroud offset from and affixed to said rear face of said base plate, said shroud shrouding said hole in said base plate, and a shaft having a first end secured to said shroud and a second end extending through said hole in said base plate; and wherein said rotational assembly comprises:

a front rotational plate having a top edge and a bottom edge and having a front face and a rear face, and a sleeve having a first end secured to said front rotational plate and a second end projecting from said rear face of said front rotational plate, said sleeve rotatably receiving said shaft of said base assembly whereby said rotational assembly rotates relative to said base assembly about said shaft of said base assembly.

2. The device of claim 1, wherein said lift arm mounting means comprises:

an upper lip protruding from said rear face of said base plate along said top edge thereof, and a lower lip protruding from said rear face of said base plate along said bottom edge thereof, said lower lip having a pair of lock ports formed therein, wherein said upper lip is adapted to fit over a forward end of each of said pair of lift arms and wherein each of said pair of lock ports are adapted to receive a lock pin provided at said forward end of each of said pair of lift arms.

3. The device of claim 1, wherein said work attachment mounting means comprises:

a retaining ledge provided along said top edge of said front rotational plate adjacent said front face thereof, and a pair of retractable locking pins mounted to said front rotational plate in spaced relation, each of said retractable locking pins retractably protruding from said bottom edge of said front rotational plate adjacent said front face thereof, wherein said retaining ledge is positionable under an upper retaining member provided on said work attachment and wherein each of said pair of retractable locking pins are engagable with a lower bracket of said work attachment.

4. A device for converting a non-rotatable skid steer loader work attachment to a rotatable skid steer loader work attachment, said skid steer loader having a pair of lift arms with each lift arm having a longitudinal axis said device comprising:

a base assembly having lift arm mounting means thereon for removably mounting said base assembly to a pair of lift arms of a skid steer loader, said lift arm mounting means being adapted such that said base assembly is removable from said lift arms to permit direct mounting of a work attachment to said lift arms when desired;

a rotational assembly rotatable coupled to said base assembly by a pivot assembly; and a rotation means for rotating said rotational assembly relative to said base assembly through 360 degrees in a plane substantially transverse to said longitudinal axis of each of said pair of lift arms of said skid steer loader, said rotational assembly including a work attachment mounting means adapted for mounting of a work attachment thereto whereby said rotational assembly and said work attachment are conjointly rotatable relative to said base assembly, said work attachment mounting means being adapted such that said work attachment is removable from said rotational assembly to permit mounting of a different work attachment to said rotational assembly when desired, whereby said base assembly and said rotational assembly form a unit removably interposable between said skid steer loader and said work attachment to permit selective rotational mounting of a variety of work attachments to said skid steer loader;

wherein said base assembly comprises:

a base plate having a top edge and a bottom edge and having a front face and a rear face, said base plate having a hole therethrough, a shroud offset from and affixed to said rear face of said base plate, said shroud shrouding said hole in said base plate, and a shaft having a first end secured to said shroud and a second end extending through said hole in said base plate; and wherein said shaft of said base assembly has a bore extending therethrough, and wherein said rotation means comprises:

a direct hydraulic actuator including a direct drive shaft having a free end, said direct hydraulic actuator mounted to said base assembly and said direct drive shaft rotatably extending through said bore provided through said shaft of said base assembly, said free end of said direct drive shaft secured to said rotational assembly whereby said direct drive shaft and said rotational assembly conjointly rotate relative to said base assembly.

5. The device of claim 4, wherein said lift arm mounting means comprises:

an upper lip protruding from said rear face of said base plate along said top edge thereof, and a lower lip protruding from said rear face of said base plate along said bottom edge thereof, said lower lip having a pair of lock ports formed therein, wherein said upper lip is adapted to fit over a forward end of each of said pair of lift arms and wherein each of said pair of lock ports are adapted to receive a lock pin provided at said forward end of each of said pair of lift arms.

6. The device of claim 4, wherein said work attachment mounting means comprises:

a retaining ledge provided along said top edge of said front rotational plate adjacent said front face thereof, and a pair of retractable locking pins mounted to said front rotational plate in spaced relation, each of said retractable locking pins retractably protruding from said bottom edge of said front rotational plate adjacent said front face thereof, wherein said retaining ledge is positionable under an upper retaining member provided on said work attachment and wherein each of said pair of retractable locking pins are engagable with a lower bracket of said work attachment.

7. A device for use in rotatably mounting a work attachment to a skid steer loader including a pair of lift arms each having a longitudinal axis, said device comprising:

a base assembly having a front surface and a rear surface, said base assembly including a lift arm mounting means adjacent said rear surface thereof for removably mounting said base assembly on said pair of lift arms of said skid steer loader;

a rotational assembly having a front surface and a rear surface, said rotational assembly rotatably coupled to said base assembly by a pivot assembly, wherein said rear surface of said rotational assembly substantially parallels and is substantially adjacent to said front surface of said base assembly; and a rotation means mounted on said base assembly for rotating said rotational assembly relative to said base assembly through 360 degrees in a plane transverse to said longitudinal axis of each of said pair of lift arms of said skid steer loader, said rotational assembly including a work attachment mounting means adjacent said front surface thereof for removably mounting said work attachment thereto whereby said rotational assembly and said work attachment are conjointly rotatable relative to said base assembly;

wherein said base assembly comprises:

a base plate having a hole therethrough, and a shaft mounted to said base plate and extending through said hole in said base plate;

wherein said rotational assembly comprises:

a front rotational plate having a rear face, and a sleeve having a first end secured to said front rotational plate and a second end projecting from said rear face of said front rotational plate, said second end of said sleeve fitting through said hole in said base plate of said base assembly, said sleeve rotatable receiving said shaft of said base assembly;

wherein said rotation means comprises:

a hydraulic actuator mounted to said base assembly, said hydraulic actuator including a drive shaft having a free end, a driver sprocket fixedly mounted on said free end of said drive shaft and driven by said drive shaft, a driven sprocket fixedly mounted on said second end of said sleeve of said rotational assembly, and a chain operably connecting said driver sprocket and said driven sprocket wherein rotation of said driver sprocket is transferred to said driven sprocket by said chain whereby said driven sprocket, said sleeve of said rotational assembly, and said rotational assembly conjointly rotate relative to said base assembly about said shaft of said base assembly, said driver sprocket, said driven sprocket, and said chain positioned between said base plate and said shroud of said base assembly.

8. The device of claim 7, wherein said lift arm mounting means comprises:

an upper lip protruding from said rear face of said base plate along a top edge thereof, and a lower lip protruding from said rear face of said base plate along a bottom edge thereof, said lower lip having a pair of lock ports formed therein, wherein said upper lip is adapted to fit over a forward end of each of said pair of lift arms and wherein each of said pair of lock ports are adapted to receive a lock pin provided at said forward end of each of said pair of lift arms.

9. The device of claim 7, wherein said rotational assembly further comprises:

a pair of bearings fitted within said sleeve, said shaft of said base assembly fitted within said pair of bearings whereby said rotational assembly freely rotates about said shaft of said base assembly.

10. The device of claim 7, wherein said work attachment mounting means comprises:

a retaining ledge provided along a top edge of said front rotational plate adjacent a front face thereof, and a pair of retractable locking pins mounted to said front rotational plate in spaced relation, each of said retractable locking pins retractably protruding from a bottom edge of said front rotational plate adjacent said front face thereof, wherein said retaining ledge is positionable under an upper retaining member provided on said work attachment and wherein each of said pair of retractable locking pins are engagable with a lower bracket of said work attachment.

11. A device for use in rotatably mounting a work attachment to a skid steer loader including a pair of lift arms each having a longitudinal axis, said device comprising:

a base assembly having a front surface and a rear surface, said base assembly including a lift arm mounting means adjacent said rear surface thereof for removably mounting said base assembly on said pair of lift arms of said skid steer loader;

a rotational assembly having a front surface and a rear surface, said rotational assembly rotatably coupled to said base assembly by a pivot assembly, wherein said rear surface of said rotational assembly parallels and is adjacent to said front surface of said base assembly; and a rotation means mounted on said base assembly for rotating said rotational assembly relative to said base assembly through 360 degrees in a plane transverse to said longitudinal axis of each of said pair of lift arms of said skid steer loader;

said rotational assembly including a work attachment mounting means adjacent said front surface thereof for removably mounting said work attachment thereto whereby said rotational assembly and said work attachment are conjointly rotatable relative to said base assembly;

wherein said base assembly comprises:

a base plate having a top edge and a bottom edge and having a front face and a rear face, said base plate having a hole therethrough, a shroud offset from and affixed to said rear face of said base plate, said shroud shrouding said hole in said base plate, and a shaft having a first end secured to said shroud and a second end extending through said hole in said base plate;

wherein said rotational assembly comprises:

a front rotational plate having a top edge and a bottom edge and having a front face and a rear face, and a sleeve having a first end secured to said front rotational plate and a second end projecting from said rear face of said front rotational plate, said second end of said sleeve fitting through said hole in said base plate of said base assembly, said sleeve rotatable receiving said shaft of said base assembly whereby said rotational assembly rotates relative to said base assembly about said shaft of said base assembly;

wherein said rotation means comprises:

a hydraulic actuator mounted to said shroud of said base assembly, said hydraulic actuator including a drive shaft having a free end, said free end of said drive shaft of said hydraulic actuator extending through a hole provided in said shroud, a driver sprocket fixedly mounted on said free end of said drive shaft and driven by said drive shaft, a driven sprocket fixedly mounted on said second end of said sleeve of said rotational assembly, and a chain operably connecting said driver sprocket and said driven sprocket wherein rotation of said driver sprocket is transferred to said driven sprocket by said chain whereby said driven sprocket, said sleeve of said rotational assembly, and said rotational assembly conjointly rotate relative to said base assembly about said shaft of said base assembly, said driver sprocket, said driven sprocket, and said chain positioned between said base plate and said shroud of said base assembly.

12. A device for use in rotatably mounting a work attachment to a skid steer loader including a pair of lift arms each having a longitudinal axis, said device comprising:

a base assembly having a front surface and a rear surface, said base assembly including a lift arm mounting means adjacent said rear surface thereof for removably mounting said base assembly on said pair of lift arms of said skid steer loader;

a rotational assembly having a front surface and a rear surface, said rotational assembly rotatable coupled to said base assembly by a pivot assembly, wherein said rear surface of said rotational assembly parallels and is adjacent to said front surface of said base assembly; and a rotation means mounted on said base assembly for rotating said rotational assembly relative to said base assembly through 360 degrees in a plane transverse to said longitudinal axis of each of said pair of lift arms of said skid steer loader, said rotational assembly including a work attachment mounting means adjacent said front surface thereof for removably mounting said work attachment thereto whereby said rotational assembly and said work attachment are conjointly rotatable relative to said base assembly;

wherein said base assembly comprises:

a base plate having a top edge and a bottom edge and having a front face and a rear face, said base plate having a hole therethrough, a shroud offset from and affixed to said rear face of said base plate, said shroud shrouding said hole in said base plate, and a shaft having a first end secured to said shroud and a second end extending through said hole in said base plate;

wherein said rotational assembly comprises:

a front rotational plate having a top edge and a bottom edge and having a front face and a rear face, and a sleeve having a first end secured to said front rotational plate and a second end projecting from said rear face of said front rotational plate, said second end of said sleeve fitting through said hole in said base plate of said base assembly, said sleeve rotatably receiving said shaft of said base assembly whereby said rotational assembly rotates relative to said base assembly about said shaft of said base assembly;

wherein said shaft of said base assembly has a bore extending therethrough, and wherein said rotation means comprises:

a direct hydraulic actuator including a direct drive shaft having a free end, said direct hydraulic actuator mounted to said base assembly and said direct drive shaft rotatably extending through said bore provided through said shaft of said base assembly, said free end of said direct drive shaft secured to said rotational assembly whereby said direct drive shaft and said rotational assembly conjointly rotate relative to said base assembly.

* * * * *